US007658513B2

(12) United States Patent
Peck

(10) Patent No.: US 7,658,513 B2
(45) Date of Patent: Feb. 9, 2010

(54) LED ILLUMINATION DEVICE WITH A HIGHLY UNIFORM ILLUMINATION PATTERN

(75) Inventor: John P. Peck, Manasquan, NJ (US)

(73) Assignee: Dialight Corporation, Farmingdale, NJ (US)

( * ) Notice: Subject to any disclaimer, the term of this patent is extended or adjusted under 35 U.S.C. 154(b) by 351 days.

(21) Appl. No.: 11/745,836

(22) Filed: May 8, 2007

(65) Prior Publication Data

US 2008/0247170 A1 Oct. 9, 2008

Related U.S. Application Data

(63) Continuation-in-part of application No. 11/620,968, filed on Jan. 8, 2007, which is a continuation-in-part of application No. 11/069,989, filed on Mar. 3, 2005, now Pat. No. 7,160,004.

(51) Int. Cl.
*F21V 33/00* (2006.01)

(52) U.S. Cl. ..... 362/298; 362/800

(58) Field of Classification Search ..... 362/298
See application file for complete search history.

(56) References Cited

U.S. PATENT DOCUMENTS

| | | | | |
|---|---|---|---|---|
| 4,268,799 | A | 5/1981 | McCrickerd | |
| 4,929,866 | A | 5/1990 | Murata et al. | |
| 5,136,483 | A | 8/1992 | Schoniger et al. | |
| 5,272,570 | A | 12/1993 | Yoshida et al. | |
| 5,642,933 | A | 7/1997 | Hitora | |
| 5,769,532 | A | 6/1998 | Sasaki | |
| 5,800,051 | A | 9/1998 | Gampe et al. | |
| 5,929,788 | A | 7/1999 | Vukosic | |
| 7,078,700 | B2 | 7/2006 | Chandhok et al. | |
| 7,160,004 | B2 | 1/2007 | Peck | |
| 2003/0169599 | A1 | 9/2003 | Natsume | |
| 2003/0193807 | A1 | 10/2003 | Rizkin et al. | |
| 2004/0042212 | A1 | 3/2004 | Du et al. | |
| 2006/0291209 | A1 * | 12/2006 | Booth et al. | 362/247 |

FOREIGN PATENT DOCUMENTS

| | | | |
|---|---|---|---|
| DE | 10 2004 001 052 | A1 | 11/2004 |
| EP | 1 357 332 | A2 | 10/2003 |
| EP | 1 411 291 | A2 | 4/2004 |
| JP | 2004341067 | | 12/2004 |
| WO | WO 01/86198 | A1 | 11/2001 |

* cited by examiner

*Primary Examiner*—Laura Tso
(74) *Attorney, Agent, or Firm*—Oblon, Spivak, McClelland, Maier & Neustadt, L.L.P.

(57) ABSTRACT

An LED (light emitting diode) illumination device that can generate a uniform light output illumination pattern. The illumination source includes first and second reflectors with a conic or conic-like shape. One reflector is mounted in the same plane as the LED and wraps around the front of the LED to redirect the light emitted along a central axis of the LED.

12 Claims, 11 Drawing Sheets

Vertical Angles

Horizontal Angles

LED ILLUMINATION DEVICE WITH A HIGHLY UNIFORM ILLUMINATION PATTERN

CROSS-REFERENCE TO RELATED APPLICATIONS

The present patent document is a continuation-in-part of U.S. application Ser. No. 11/620,968 filed on Jan. 8, 2007, which in turn is a continuation-in-part of U.S. application Ser. No. 11/069,989 filed Mar. 3, 2005, the entire contents of each of which are hereby incorporated herein by reference.

BACKGROUND OF THE INVENTION

Field of the Invention

The present invention is directed to an LED (light emitting diode) and reflector illumination device that creates a highly uniform illumination/intensity pattern.

Generally, light sources emit light in a spherical pattern. Light emitting diodes (LEDs) are unique in that they emit light into a hemispherical pattern from about −90° to 90° as shown in FIG. 1*a*. Therefore, to utilize an LED as a light source in a conventional manner reflectors are placed around an LED.

FIG. 2 shows a background LED illumination device 10 including an LED 1 and a reflector 11. In the background LED illumination device in FIG. 2 the LED 1 and reflector 11 are oriented along the same axis 12, i.e. along a central optical axis 12 of the reflector 11, and the LED 1 points directly out of the reflector 11 along the axis 12.

With the LED illumination device 10 in FIG. 2, wide-angle light is redirected off of the reflector 11 and narrow angle light directly escapes. The result is that the output of the LED illumination device 10 is a narrower and more collimated beam of light. Thereby, with such an LED illumination device 10, a circular-based illumination pattern is created. Since most LEDs have a Cosine-like intensity pattern as shown in FIG. 1*a*, this results in a hotspot directly in front of the LEDs when illuminating a target surface. The reflector 11 can increase the illuminance at various area of the target surface but the reflector 11 cannot reduce the hotspot directly in front of the LED.

SUMMARY OF THE INVENTION

The present inventor recognized that certain applications require highly uniform illumination patterns. In some cases the illumination must not exceed a ratio of 10 to 1 between the highest and lowest illuminance values within the lighted target area. Some examples of this are street lighting, parking garage lighting, and walkway lighting. Applications such as wall-mounted lights require a highly uniform non-circular pattern to direct light at a floor, and not waste light by over illuminating the wall.

As another example of an application in which it would be advantageous to create a non-circular pattern, in certain applications an illumination or intensity distribution may be desired that is broader in one direction than another direction. Automotive lighting applications such as head lamps, turn signals, or tail lamps are examples of such applications. As an example an automotive tail lamp has a desired intensity distribution that is much wider in a horizontal plane than a vertical plane. Such a type of light pattern may be referred to as a long-and-narrow distribution.

Other applications may also benefit from creating a non-circular light output illumination/intensity pattern.

Accordingly, one object of the present invention is to provide a novel LED illumination device that can generate a highly uniform illumination pattern.

A further object of the present invention is to generate a non-circular light output illumination/intensity pattern.

The present invention achieves the above-noted results by providing a novel illumination source including reflectors with a conic or conic-like shape. Further, a light emitting diode (LED) is positioned with respect to a first reflector so that the high intensity light emitted along the central axis of the LED is diverted away from the central axis by the first reflector. A second reflector located opposite the first reflector directs light from a higher angle toward the angle that corresponds to the central axis of the LED. This second reflector essentially fills in light along the central axis of the LED but with a lower intensity that is more appropriate to illuminate the area directly in front of and nearest the LED.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 3:
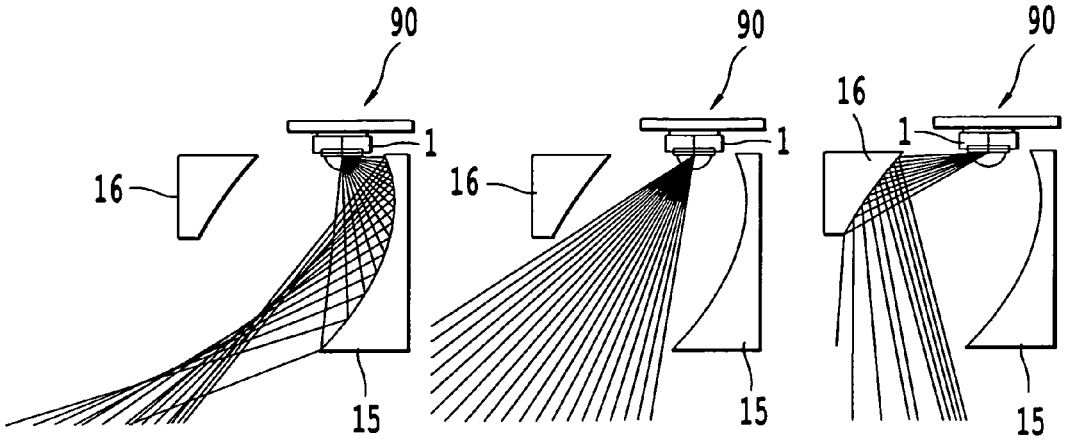
FIGS. 3 and 4 show an LED illumination device according to an embodiment of the present invention.

Referring now to the drawings, wherein like reference numerals designate identical or corresponding parts throughout the several views, and more particularly to FIG. 3 thereof, an embodiment of an LED illumination device 90 of the present invention is shown. As shown in FIG. 3, an LED illumination device 90 of the present invention includes the LED light source 1, a first reflector 15, and a second reflector 16.

Figure 4:
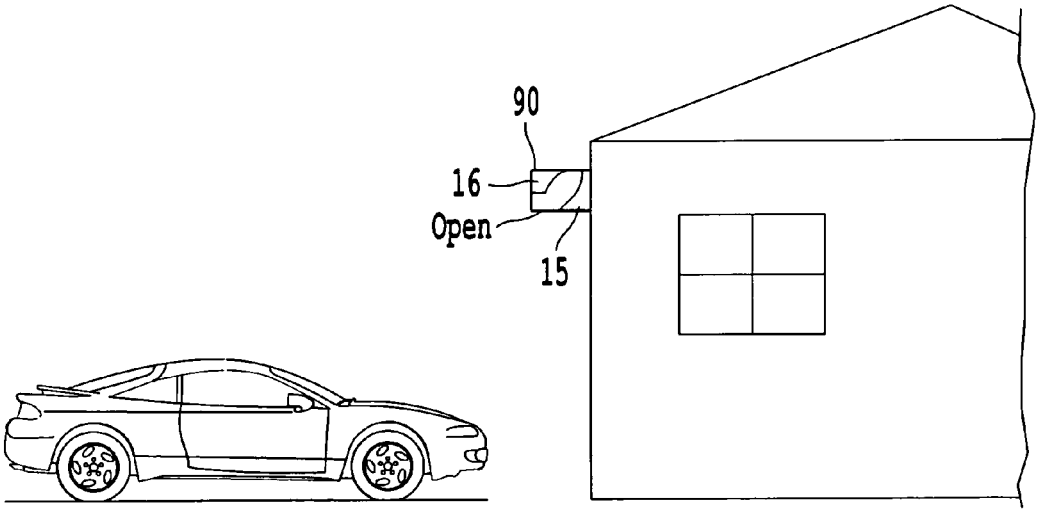

In one embodiment the LED illumination device of FIG. 3 can be used to create a semicircular illumination pattern used for applications such as for a wall-mounted light shown in FIG. 4. In these applications it is desirable to direct the majority of the light forward with only a small amount of light directed backward on the wall. The LED illumination device of FIG. 3, in the configuration and orientation shown, can be inserted into and used in the light fixture shown in FIG. 4.

Figure 1A:
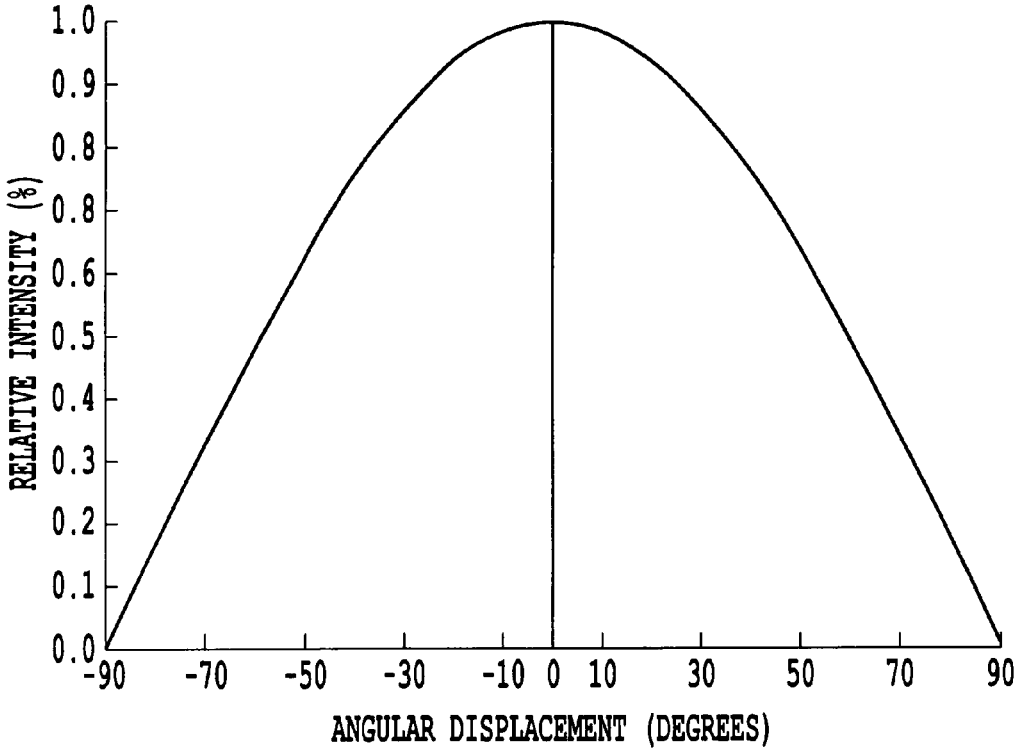
FIGS. 1*a* and 1*b* show the intensity distribution of a conventional LED.

In the embodiment of the present invention shown in FIG. 3, the reflector 15 is shaped so that the light emitted directly in front of the LED 1 (light emitted directly along the central optical axis of the LED 1) is redirected away from the central axis of the LED by the reflector 15. The light is reflected by reflector 15 from a positive angle to a dominantly negative angle (FIG. 1*a* shows the positive angle from 0° to 90° and the negative angle from −90° to 0°). The second reflector 16 is used to fill in the light that would have traveled to the illuminating surface along the central axis of the LED 1. With reference to FIG. 3, a portion of the light is redirected by second reflector 16 from a negative angle to a positive angle.

There is an opening between the two reflectors 15, 16 to illuminate the area on the ground that is not covered by the two reflectors 15, 16, which may be the target area located between the areas illuminated by the first and second reflectors 15, 16. Such an orientation creates a light output with a uniform and semicircle based illumination/intensity light pattern suitable for wall-mounting lighting applications, such as shown in FIG. 4.

Figure 1B:
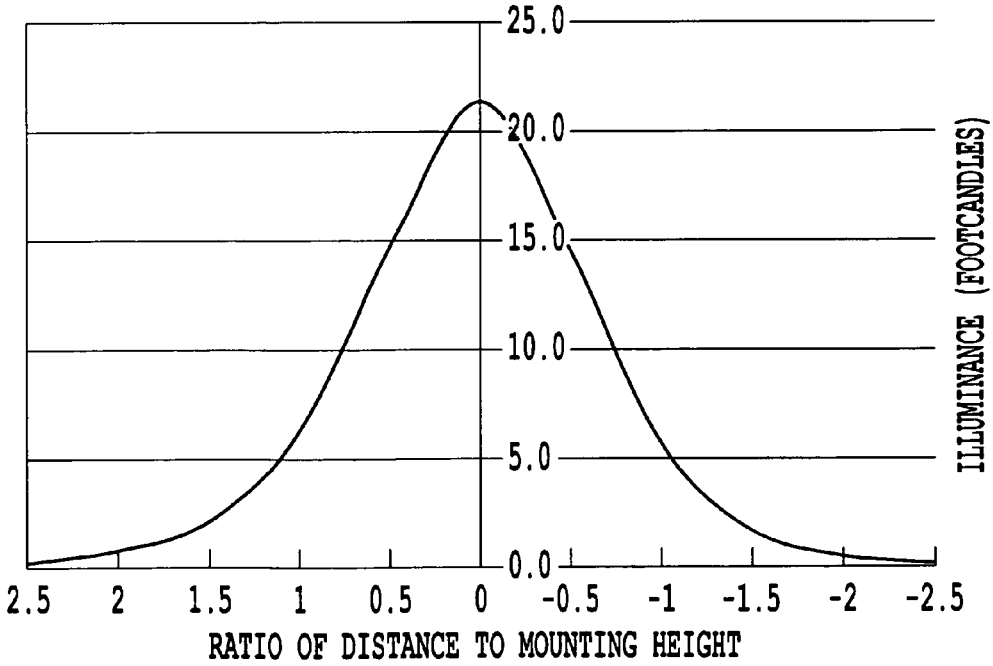

FIG. 1*a* shows the cosine-like intensity profile of a conventional example LED and FIG. 1*b* shows the illuminance profile that results when an example luminaire with conventional LEDs illuminates a surface directly in front of the LED when no optic is used. In this case the example luminaire includes 52 LEDs each emitting 83 lumens. As shown in FIG. 1*b*, there is a hotspot in the center and the illuminance drops very quickly moving away from the center axis. This is the known cosine-fourth effect. In this example the maximum illuminance is about 21 footcandles and the minimum illuminance is about 0.2 footcandles. The resulting illuminance ratio is over 100 to 1 and would exceed the requirements of most applications.

Figure 2:
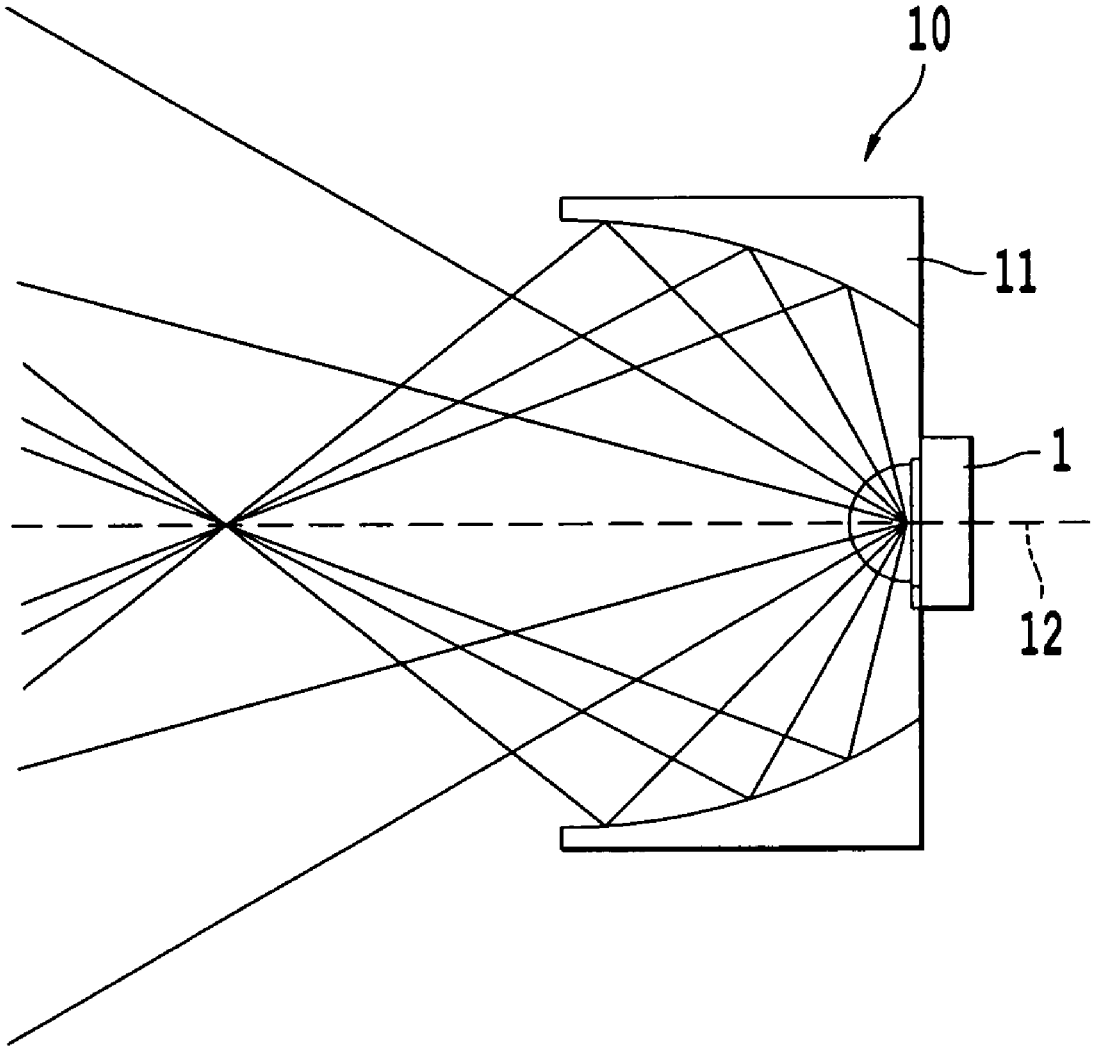
FIG. 2 shows a background art LED illumination device.

As noted above with respect to FIG. 2, a background LED illumination device 10 has the LED 1 and the reflector 11 approximately oriented along a same central axis. The result is the generation of a circular-based illumination/intensity pattern. The reflector 11 can be used to increase the illuminance in various areas of the target surface. However, it is not possible to reduce the illuminance directly in front of the LED using the reflector optic 11 shown in FIG. 2. In the device of FIG. 2 there will always be a hotspot on the illumination surface directly in front of the LED. In that example the illumination does not fall below 21 footcandles. Furthermore, when illuminating an area with a ratio of distance to mounting height as much as 2.5, substantially all of the light within +/−68° is already directed into the target area. FIG. 1*a* shows there is very little light left beyond 68° that can be redirected into the target area with the reflector. This small amount of light cannot significantly increase the low illuminance regions at the edge of the target area.

In contrast to such a background structure such as in FIG. 2, in the embodiment in FIG. 3 the surface of the first reflector 15 crosses directly in front of the central optical axis of the LED 1. As a result, the highest intensity light is diverted away from the central axis and toward higher angles. The hotspot is eliminated and this high intensity light is directed toward the edge of the target area where higher intensity light is needed due to the cosine effects.

If only the first reflector 15 was utilized, a dark area would be left underneath and behind the illumination device 90. However, the second reflector 16 can be used to redirect light emitted from the other side of the LED 1 to fill in angles obscured by the first reflector 15. The light emitted from the side of the LED 1 is of lower intensity and therefore will not create a hotspot in the center target area located directly in front of the illumination device 90. The reflector 16 can also be shaped to direct a small amount of light backward to appropriately illuminate the wall.

There is an opening between the two reflectors 15, 16 to allow light from the LED 1 to directly illuminate the region of the target area that is not illuminated by the first and second reflectors 15, 16. Considering this, the reflector surfaces could also be designed to provide a smooth transition across the target area.

To create the desired light output intensity pattern, the reflectors 15, 16 in the embodiment of FIG. 3 can have a conic or conic-like shape. The reflectors 15, 16 can take the shape of any conic including a hyperbole, a parabola, an ellipse, a sphere, or a modified conic.

The reflectors 15, 16 may also be formed of a typical hollowed reflecting surface. If the reflectors 15, 16 are typical hollowed reflecting surfaces, they can be formed of a metal, a metalized surface, or another reflectorized surface.

Further details as to the conic or conic-like shape that the reflectors 15, 16 can take is discussed below.

Figure 6A:
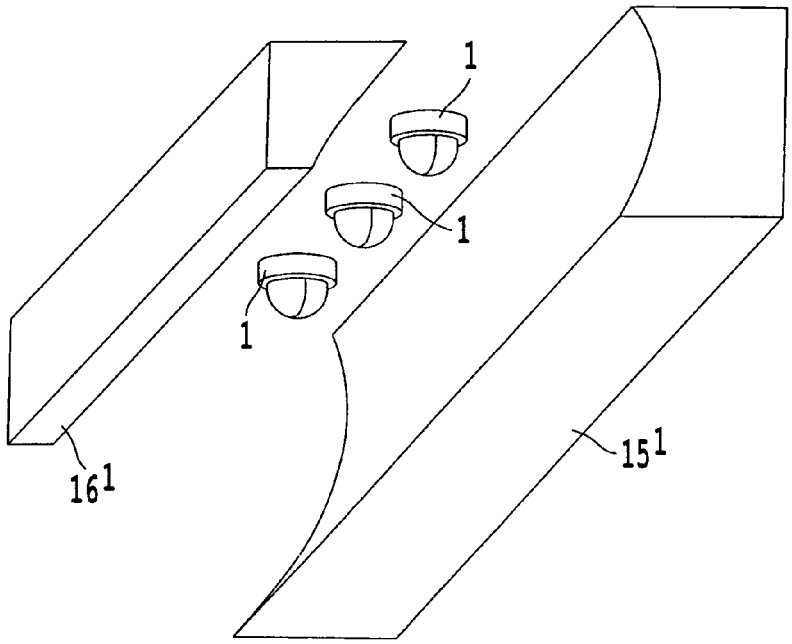
FIGS. 6*a* and 6*b* show an LED illumination device according to further embodiments of the present invention.

FIG. 6*a* shows an example of a modification of the embodiment of FIGS. 3, 4 in which the reflectors 15, 16 in the embodiment of FIG. 3 are extruded or projected linearly into reflectors 15', 16' and an array of LEDs 1 is used.

Figure 5:
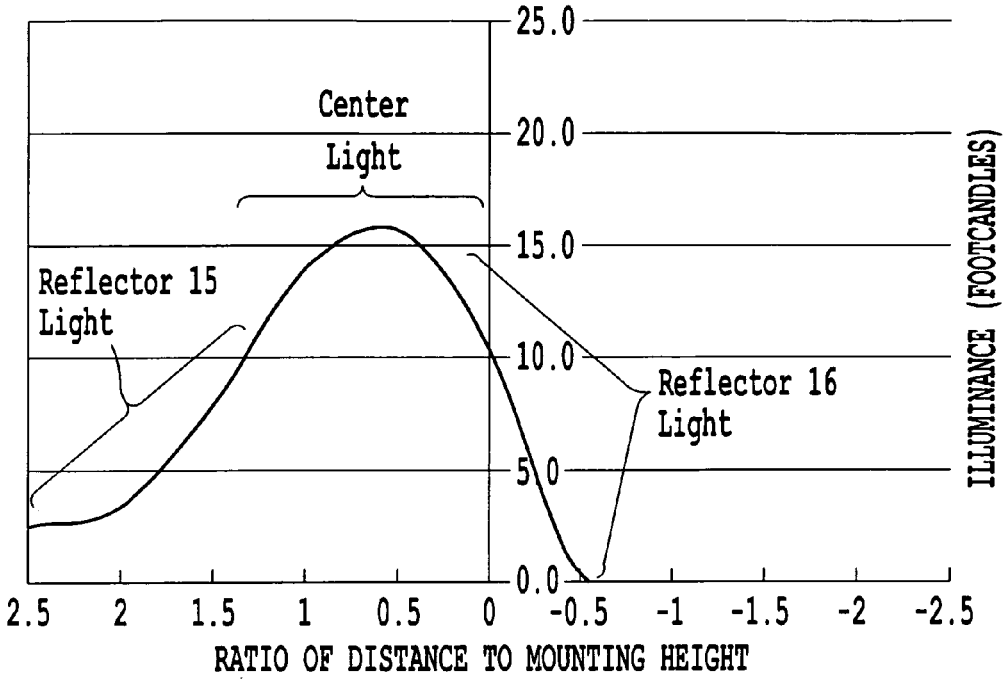
FIG. 5 shows an illumination distribution realized by the LED illumination device of FIG. 6*a;*

FIG. 5 shows an example of the illuminance profile created by the embodiment of the illumination device of FIG. 6*a* when 52 LEDs each emitting 83 lumens are used. The brightest area has been reduced from about 21 to about 16 footcandles. The light is appropriately directed forward for applications such as wall-mount lights. The illumination gradually decreases out to a ratio of distance to mounting height of 2.5. The least bright region at the edge has increased from about 0.2 footcandles to about 2.6 footcandles. The resulting illuminance ratio is 6 to 1 and would meet the requirements of most applications. With the embodiment of FIG. 6*a* in the invention it would not be difficult to maintain an almost constant illumination out to the edge of the target area, but the intensity at high angles would be very high and may cause objectionable glare.

Figure 6B:
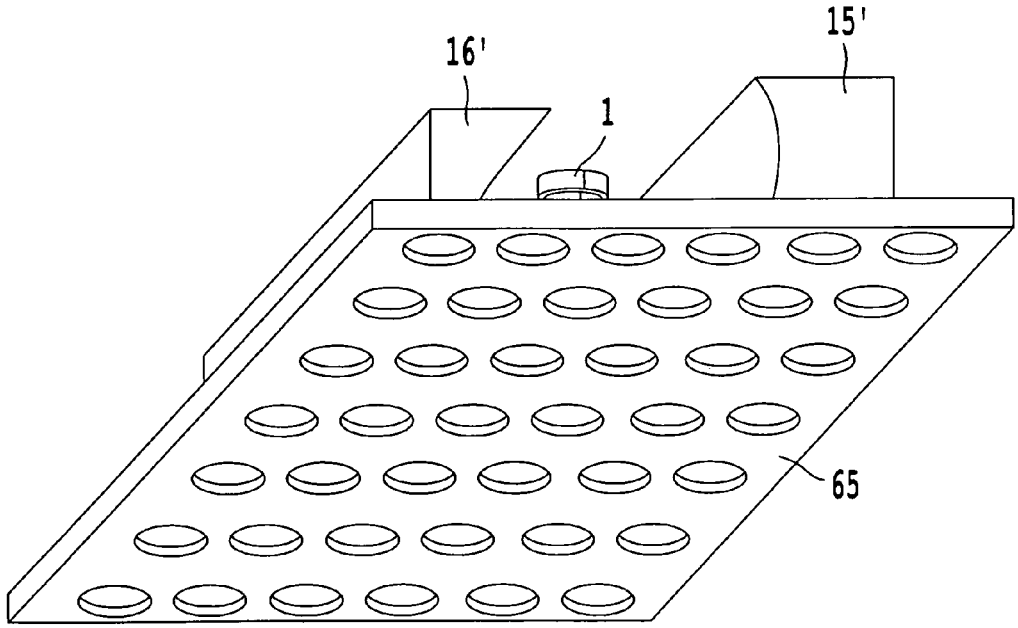

A cover or lens 65, as shown in FIG. 6*b*, can be placed forward of the LED 1 and reflectors 15', 16' to further modify the illumination/intensity profile. The cover or lens 65 may spread the light perpendicular to the linear or projected reflector. The cover or lens 65 could also spread the light in all directions. The cover or lens 65 could also primarily modify the light not reflected off either of the reflectors.

Figure 7A:
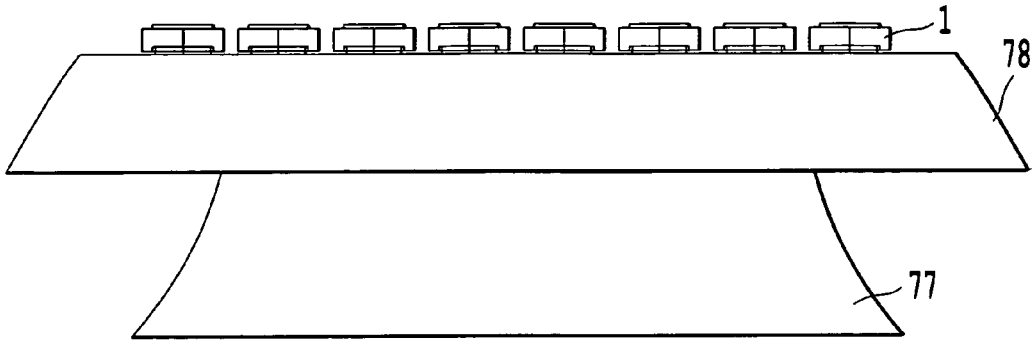
FIG. 7*a* shows a side view and FIG. 7*b* shows an isometric view of an LED illumination device according to a further embodiment of the present invention.
Figure 7B:
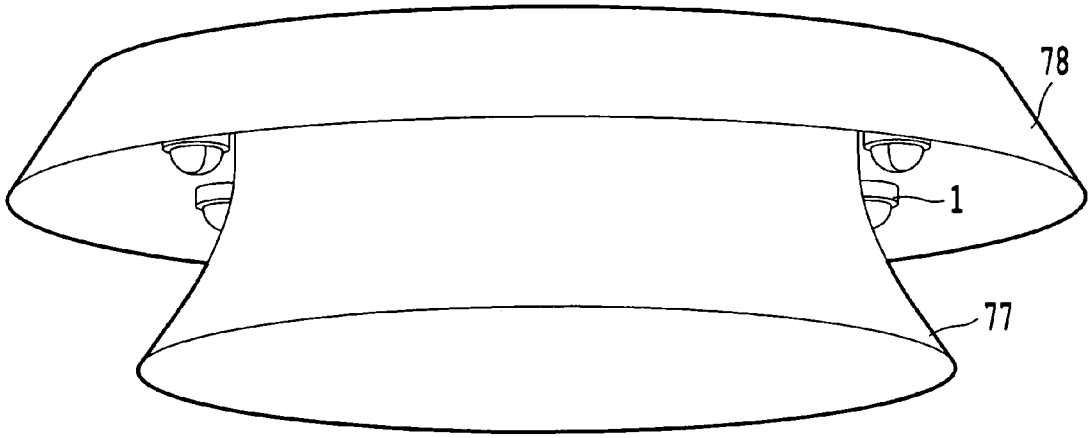

As a further employment of the embodiment of FIGS. 3, 4, when utilizing an array of LEDs 1, the reflectors can also be curved or can be completely revolved in a circle as shown in FIGS. 7*a*, 7*b* to form a first reflector 77 (similar to first reflector 15) and a second reflector 78 (similar to second reflector 16). FIG. 7*a* shows a side view and FIG. 7*b* shows an isometric view of that further embodiment. Revolving the reflector and using an array of LEDs also creates a highly uniform circular illumination pattern with no hotspot in the center.

Figure 8:
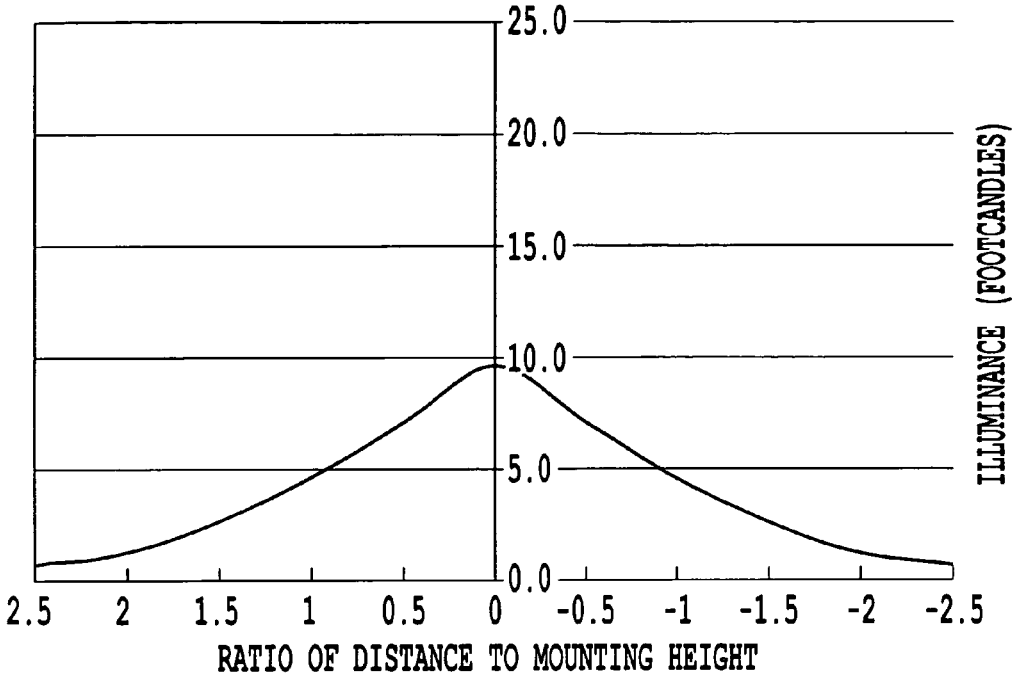
FIG. 8 shows an illumination pattern of the LED illumination device of FIGS. 7*a* and 7*b;*

An isofootcandle chart for 52 83-lumen LEDs with a revolved reflector of FIGS. 7*a*, 7*b* is shown in FIG. 8.

As a modification of the embodiments of FIGS. 7*a*, 7*b*, the reflectors can be revolved not only in a circle but can have more complicated curves such as those satisfied by the conic or conic like functions discussed below.

Figure 9:
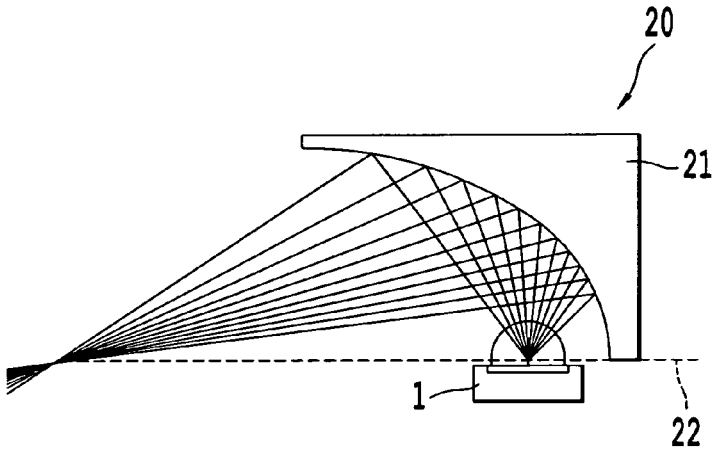
FIGS. 9 and 10 show an LED illumination device according to further embodiments of the present invention.

FIG. 9 shows an LED illumination device 20 of another embodiment of the present invention. In the embodiment of the present invention shown in FIG. 9, the LED 1 is rotated approximately 90°, and preferably 90°±30°, off-axis with respect to the reflector 21, i.e. rotated approximately 90° with respect to a central optical axis 22 of the reflector 21. Such an orientation creates an output semicircle based illumination/intensity light pattern.

Figure 10:
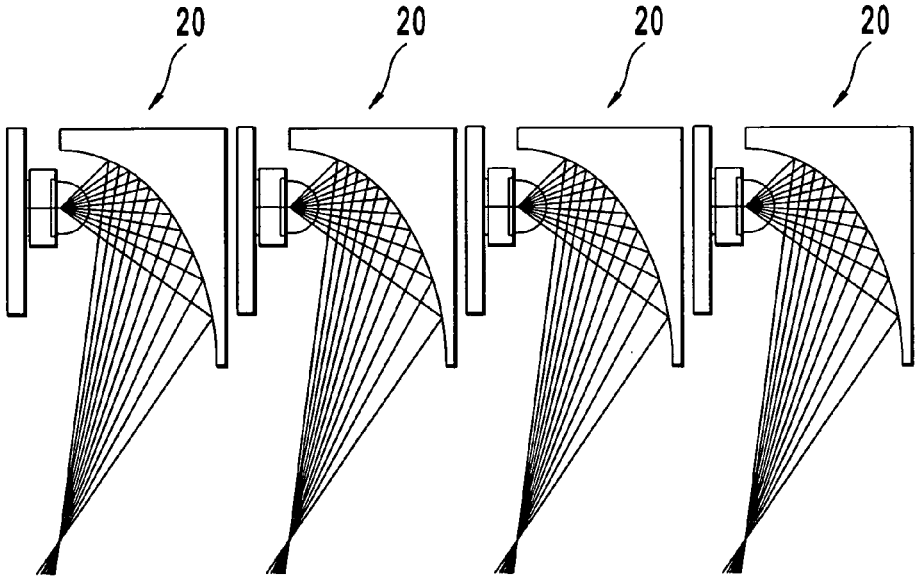

FIG. 10 shows an array of illumination devices 20 of LEDs and reflectors at 90° with respect to the LEDs. With the configuration in FIG. 10, the LED illumination device therein could also be used in an application such as a wall mounted luminaire as shown in FIG. 4.

As noted above with respect to FIGS. 1-2, a background LED illumination device 10 has the LED 1 and the reflector 11 approximately oriented along a same central axis. The result is generation of a circular-based illumination/intensity pattern.

In contrast to the background structure such as in FIG. 2, in the embodiment in FIG. 9 the LED 1 is rotated at approximately 90°, with respect to the central axis 22 of the reflector 21 to create a semicircle-based illumination/intensity pattern.

To create the semicircle-like light output intensity pattern, the reflector 21 also has a conic or conic-like shape. The reflector 21 can take the shape of any conic including a hyperbola, a parabola, an ellipse, a sphere, or a modified conic.

The reflector 21 may be formed of a typical hollowed reflecting surface. If the reflector 21 is a typical hallowed reflecting surface, it can be formed of a metal, a metalized surface, or another reflectorized surface.

Figure 11:
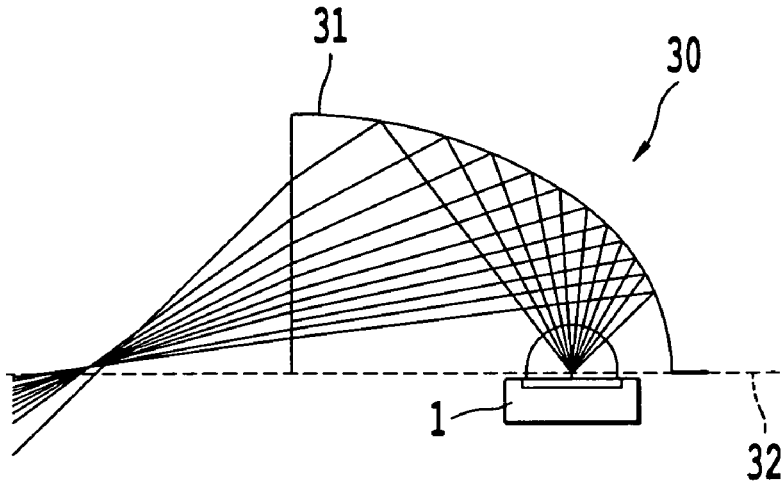
FIG. 11 shows an LED illumination device according to a further embodiment of the present invention.

Or, in a further embodiment of the present invention as shown in FIG. 11, an illumination device 30 can include a reflector 31 made of a solid glass or plastic material that reflects light through total internal reflection, with the LED 1 still offset approximately 90° with respect to the central axis 32 of the reflector 31.

Figure 12:
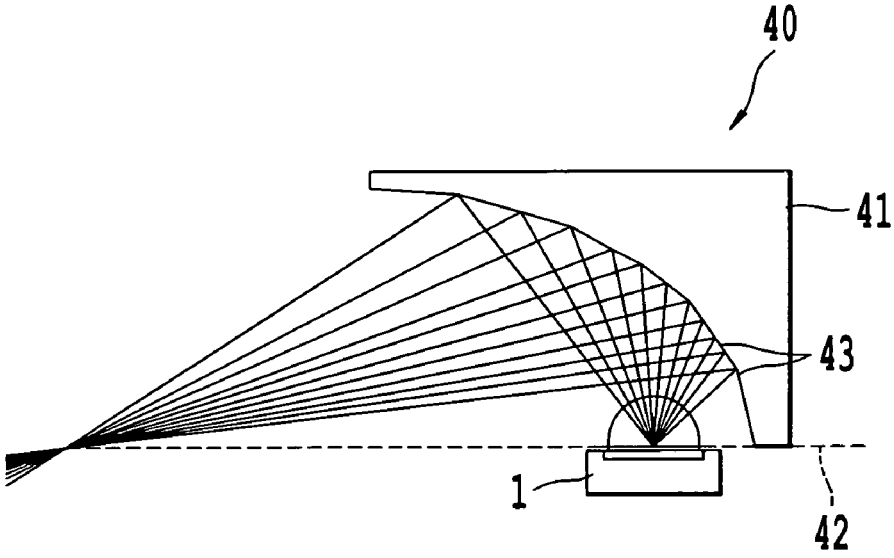
FIG. 12 shows an LED illumination device according to a further embodiment of the present invention.

In a further embodiment of the present invention as shown in FIG. 12, an illumination device 40 can include a reflector 41 with a surface having segmented or faceted conic-reflector surfaces 43. That illumination device 40 still includes an LED 1 offset approximately 90° with respect to the central axis 42 of the reflector 41.

Choosing the specific shape of any of the reflectors 15, 16, 15', 16', 21, 31, 41, 77, 78, 79 can change the illumination/intensity pattern generated by the LED illumination device 20. As noted above, the reflectors 15, 16, 15', 16', 21, 31, 41, 77, 78, 79 each have a conic or conic-like shape to realize a semicircle-based illumination/intensity pattern.

Conic shapes are used commonly in reflectors and are defined by the function:

$$z = \frac{cr^2}{1 + \sqrt{1 - (1+k)c^2r^2}} \tag{1}$$

$$r^2 = x^2 + y^2$$

where x, y, and z are positions on a typical 3-axis system, k is the conic constant, and c is the curvature. Hyperbolas (k<−1), parabolas (k=−1), ellipses (−1<k<0), spheres (k=0), and oblate spheres (k>0) are all forms of conics. The reflectors 11, 21 shown in FIGS. 2 and 9 were created using k=−0.55 and c=0.105. FIG. 9 shows the reflector 21 used in the present embodiments of the present invention. Changing k and c will change the shape of the illumination/intensity pattern. The pattern may thereby sharpen or blur, or may also form more of a donut or 'U' shape, as desired.

One can also modify the basic conic shape by using additional mathematical terms. An example is the following polynomial:

$$z = \frac{cr^2}{1 + \sqrt{1 - (1+k)c^2r^2}} + F \tag{2}$$

where F is an arbitrary function, and in the case of an asphere F can equal $$\sum_{n=2}^{10} C_{2n} r^{2n},$$

in which C is a constant.

Conic shapes can also be reproduced/modified using a set of points and a basic curve such as spline fit, which results in a conic-like shape for the reflectors 15, 16, 15', 16', 21, 31, 41, 77, 78, 79.

Thereby, one of ordinary skill in the art will recognize that the desired illumination/intensity pattern output by the illumination devices 90, 20, 30, 40 can be realized by modifications to the shape of the reflector 15, 16, 15', 16', 21, 31, 41, 77, 78, 79 by modifying the above-noted parameters such as in equations (1), (2).

Figure 13:
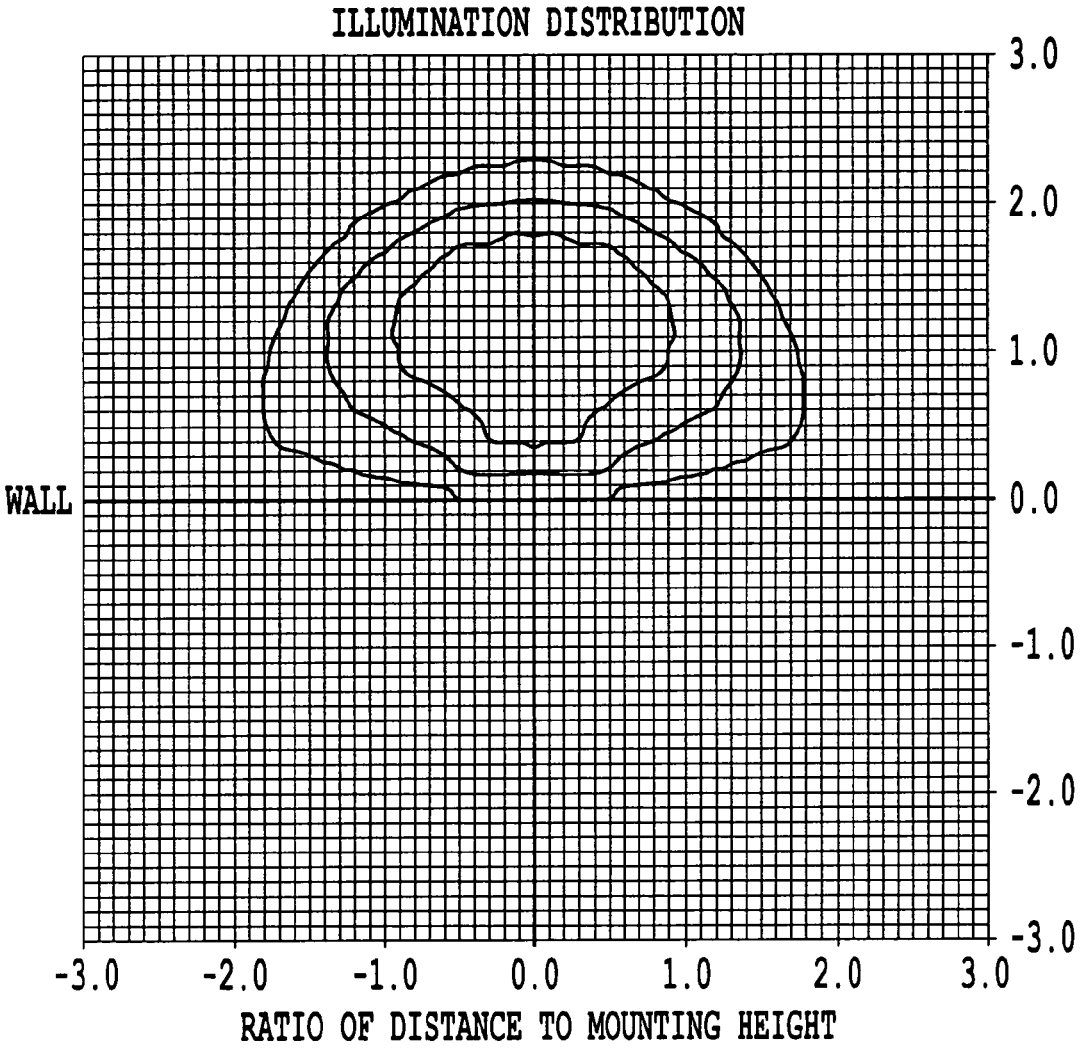
FIG. 13 shows in a chart form an illumination distribution realized by the LED device of FIG. 9.

FIG. 13 shows an example of an output light semicircle shaped illumination distribution for a wall-mounted light using the illumination device 20 of FIG. 9. In FIG. 13 the line 0.0 represents the wall, FIG. 13 showing the illumination distribution with respect to a ratio of floor distance to mounting height. As shown in FIG. 13, a semicircle illumination distribution can be realized by the illumination device 20 such as in FIG. 9 in the present specification, particularly by the reflector 21 satisfying equation (2) above.

Figure 17A:
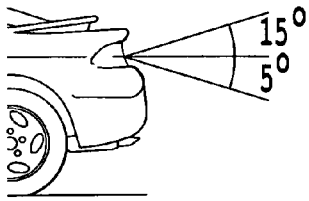
FIGS. 17*a* and 17*b* show an implementation of certain embodiments of the present invention.
Figure 17B:
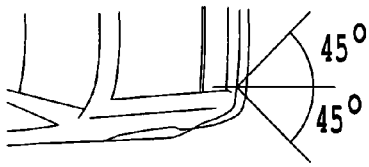

As discussed above, some illumination applications may desire an intensity distribution of output light that is broader in one direction than another. For example, an automotive lighting application such as shown in FIGS. 17*a* and 17*b* may desire a light pattern in a long-and-narrow distribution. In the above-discussed embodiments in FIGS. 9-12 the shape of the different reflectors 21, 31, and 41 can be symmetrical, although non-circular, in the horizontal and vertical axes, and thus those reflectors provide symmetrical non-circular output light intensity distribution. However, by changing the reflecting surfaces of reflectors to have a different curvature in different axes, for example to have a different curvature in the horizontal axis than in the vertical axis, different light intensity distributions can be realized, for example a long-and-narrow light intensity distribution can be output. As shown in FIGS. 17*a*, 17*b* in an automotive tail light, in a vertical direction a 20° total light distribution is output, whereas in a horizontal direction a 90° total light distribution is output, and thereby a long-and-narrow light intensity distribution is output.

Figure 14A:
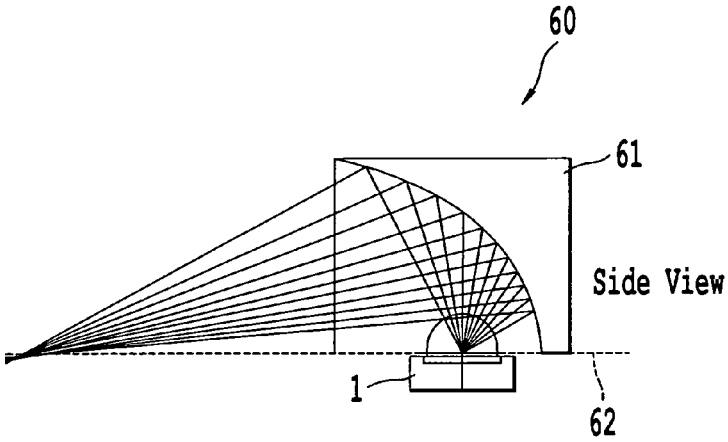
FIGS. 14*a* and 14*b* show an LED illumination device according to a further embodiment of present invention.
Figure 14B:
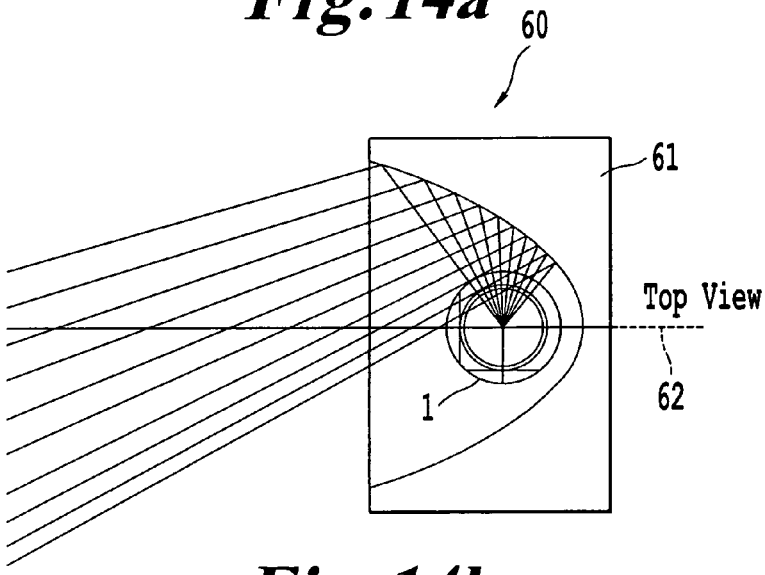

FIGS. 14*a* and 14*b* show a further embodiment of the present invention in which the light intensity distribution is changed in a horizontal axis compared with the vertical axis. FIG. 14*a* shows a side view of an illumination device 60 according to a further embodiment of the present invention including an LED light source 1, a reflector 61, and a central optical axis 62. FIG. 14*a* shows a vertical axis view of the illumination device 60. FIG. 14*b* shows that same reflector 60 from a top view, and thus shows a horizontal axis view. As shown in FIGS. 14*a* and 14*b* the shape of the reflector 61 in the horizontal axis view as shown in FIG. 14*b* differs compared to the shape of the reflector 61 in the vertical axis view as shown in FIG. 14*a*. The curvature of the vertical axis and the curvature of the horizontal axis would blend together at radials between the horizontal and vertical axis. Thereby, in the embodiment of FIGS. 14*a*, 14*b* two different reflective surface portions are offset from each other by 90°. With such a structure the light output of the illumination device 60 can have a long-and-narrow distribution that may be useful in certain environments, as a non-limiting example as an automotive tail lamp such as shown in FIGS. 18*a*, 18*b*.

Further, in the illumination device 60 of FIGS. 14*a* and 14*b* the shapes of the reflector 61 are different in both the horizontal and vertical axis, however both shapes still satisfy equations (1) or (2) noted above, and in that case the conic constant k, curvature c, or arbitrary function F would be changed for each reflector portion. Thereby, the reflector 60 effectively includes first and second reflective portions (in the respective horizontal and vertical axes) that each have a conic or conic-like shape, which differ from each other. Such conic shapes can be reproduced/modified using a set of points in a basic curve such as a spline fit, which results in a conic-like shape for each of the two different reflective portions of the reflector 61.

The embodiment noted above in FIGS. 14*a* and 14*b* shows a reflector 61 having essentially two different curvatures, one in a vertical direction as in FIG. 6*a* and one in a horizontal axis as in FIG. 14*b*.

Figure 15A:
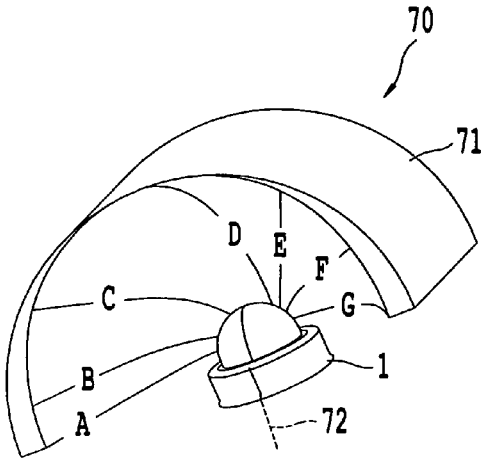
FIGS. 15*a* and 15*b* show an LED illumination device according to a further embodiment of the present invention.
Figure 15B:
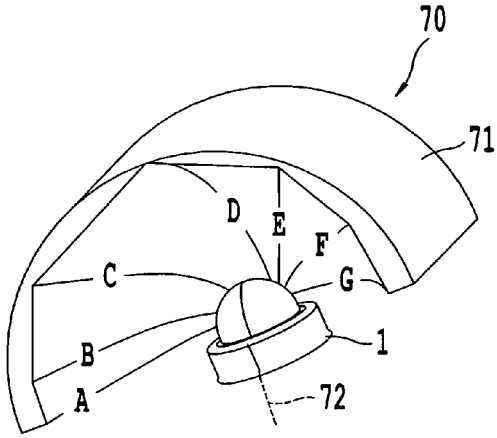

According to a further embodiment of an illumination device of the present invention as shown in FIGS. 15*a* and 15*b*, more than two curvatures can be used for a reflector surface.

FIGS. 15*a* and 15*b* show respective further illumination devices 70 and 75 each including an LED light source 1 and a central optical axis 72. In FIG. 15*a* multiple radially offset curvatures A-G are formed in the reflector 71 at different radial positions of the reflector 71. The different curvatures blend together along the reflector surface. Thereby, a more complicated illumination and intensity profile can be realized.

FIG. 15*b* shows a further illumination device 75 with a reflector 76 similar to reflector 71 in FIG. 15*a*, except that the portions of the curvature of the reflector 76 have segmented or faceted conic-reflector surfaces, similar to the embodiment in FIG. 12. Although in FIG. 12 the reflector is segmented along the curve of the reflector whereas in FIG. 15*b* the reflector is segmented radially. A modified reflector could also combine both types of segmenting from FIGS. 12 and 15*b*.

Also similar to the embodiment of FIGS. 14*a* and 14*b*, each different curvature portion A-G of the reflectors 71, 76 in FIGS. 15*a* and 15*b* can be reproduced/modified using a set of points and a basic curve such as a spline fit, which results in a conic-like shape for the reflectors 71, 76. Again, each curvature portion A-G may satisfy equations (1) or (2) noted above, and in that case the conic constant k, curvature c, or arbitrary function F would be changed for each reflector portion.

Figure 16:
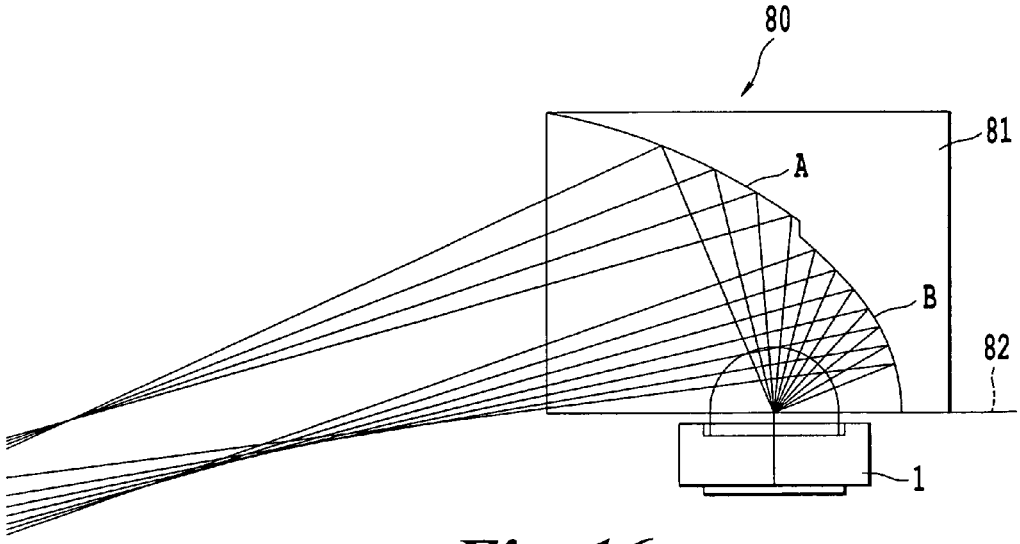
FIG. 16 shows an LED illumination device according to a further embodiment of the present invention.

FIG. 16 shows a further embodiment of an illumination device 80 according to an embodiment of the present invention. That illumination device 80 of FIG. 16 also includes an LED 1 outputting light to a reflector 81, with a similar relationship to an optical axis 82 as in the previous embodiments. In the illumination device 80 in FIG. 16 the reflector 81 along one radial positioning has two different areas A and B with different curvatures each of a conic or conic-like shape. That is, each curvature area A and B may also satisfy equations (1) or (2) above, and in that case each curvature portion A and B will satisfy those formulas with a different conic constant k, curvature c, or arbitrary function F. In that case, the conic shapes can also be reproduced/modified using a set of points and a basic curve such as a spline fit, which again results in a conic-like shape for each area A, B of the reflector 81.

In each of these further embodiments in FIGS. 14-18 noted above a more complicated illumination or intensity distribution output by the illumination devices 60, 70, 75, and 80 can be realized.

The features in the further embodiments such as in FIGS. 12, 14*a*, 14*b*, 15*a*, 15*b*, and 16 can also be applied to the illumination devices of FIGS. 3-7. That is, those illumination devices in FIGS. 3-7 can also include segmented or faceted conic-reflector surfaces 43 as in FIG. 12, different light intensity distribution in the horizontal axis compared with the vertical axis as in FIGS. 14*a* and 14*b*, multiple radially offset curvatures A-G as shown in FIGS. 15*a* and 15*b*, and reflecting surface with different areas A, B as shown in FIG. 16.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An illumination source comprising:

an LED light source with a central axis;

a first reflector having a first reflecting surface with a first conic or conic-like shape, the first reflector passing directly in front of the central axis of the LED light source; and a second reflector having a second reflecting surface with a second conic or conic-like shape, the second reflector not passing directly in front of the central axis of the LED, wherein the light reflected off the first reflector is redirected from a positive angle to a dominantly negative angle;

wherein at least a portion of the light reflected off the second reflector is redirected from a negative angle to a positive angle.

2. An illumination source according to claim 1, wherein at least a portion of the light reflected off the second reflector is redirected from a negative angle to a positive angle.

3. An illumination source according to claim 1, wherein the conic or conic-like shape of each of the first and second reflectors has a shape selected from the group consisting of: a hyperbola; a parabola; an ellipse; a sphere; or a modified conic.

4. An illumination source according to claim 1, wherein each of the first and second reflectors is formed of one of: a metal; a metalized surface; or a reflectorized surface.

5. An illumination source according to claim 1, wherein the first and second reflecting surfaces are revolved in a circle.

6. An illumination source according to claim 1, wherein the first and second reflecting surfaces are extruded or projected linearly.

7. An illumination source according to claim 5, wherein the first and second reflecting surfaces are projected along a conic or conic-like curve.

8. An illumination source according to claim 1, wherein each of said first and second reflecting surfaces satisfies:

$$z = \frac{cr^2}{1 + \sqrt{1 - (1 + k)c^2r^2}}$$
$$r^2 = x^2 + y^2,$$

in which x, y, and z are positions on a 3-axis system, k is conic constant, and c is curvature.

9. An illumination source according to claim 1, wherein each of said first and second reflecting surfaces satisfies:

$$z = \frac{cr^2}{1 + \sqrt{1 - (1 + k)c^2r^2}} + F$$
$$r^2 = x^2 + y^2,$$

in which x, y, and z are positions on a 3-axis system, k is conic constant, c is curvature, and F is an arbitrary function.

10. An illumination source according to claim 6, wherein each of said first and second reflecting surfaces satisfies:

$$z = \frac{cr^2}{1 + \sqrt{1 - (1 + k)c^2r^2}}$$
$$r^2 = x^2 + y^2,$$

in which x, y, and z are positions on a 3-axis system, k is conic constant, and c is curvature.

11. An illumination source according to claim 7, wherein each of said first and second reflecting surfaces satisfies:

$$z = \frac{cr^2}{1 + \sqrt{1 - (1 + k)c^2r^2}} + F$$
$$r^2 = x^2 + y^2,$$

in which x, y, and z are positions on a 3-axis system, k is conic constant, c is curvature, and F is an arbitrary function.

12. An illumination source according to claim 1, wherein said first and second conic or conic-like reflecting surfaces are represented by a set of points and a basic curve or a spline fit, resulting in a conic-like shape of said first and second portions of the first reflector.

* * * * *